United States Patent [19]

Overington et al.

[11] Patent Number: 4,903,482

[45] Date of Patent: Feb. 27, 1990

[54] TWO-STROKE OTTO CYCLE ENGINES

[75] Inventors: Martin T. Overington; John Stokes; Giles E. Hundleby; Samuel Lesley, all of West Sussex, England

[73] Assignee: Ricardo Group PLC, West Sussex, England

[21] Appl. No.: 344,014

[22] Filed: Apr. 26, 1989

[30] Foreign Application Priority Data

Apr. 27, 1988 [GB] United Kingdom ..... 8809922
Jul. 12, 1988 [GB] United Kingdom ..... 8816563

[51] Int. Cl.[4] ..... F01N 3/28

[52] U.S. Cl. ..... 60/301; 60/288; 123/65 PE

[58] Field of Search ..... 60/274, 288, 301; 123/65 PE

[56] References Cited

U.S. PATENT DOCUMENTS 1,477,994 12/1923 Buchi ..... 60/314
3,579,981 5/1971 Gau ..... 60/279
3,810,361 5/1974 Weaving ..... 60/301
4,304,207 12/1981 Aihara ..... 60/279

FOREIGN PATENT DOCUMENTS 253114 10/1988 Japan ..... 123/65 PE

*Primary Examiner*—Douglas Hart
*Attorney, Agent, or Firm*—McAulay, Fisher, Nissen & Goldberg

[57] ABSTRACT

A two-stoke engine comprises a cylinder accommodating a piston and having an air inlet port and an exhaust port. The exhaust port communicates with an exhaust system which includes a reduction catalyst and an oxidation catalyst. The exhaust system includes two exhaust flow paths in parallel, the first of which includes the reduction catalyst and the second of which bypasses the reduction catalyst, the downstream ends of the two flow paths being connected together upstream of the oxidation catalyst. The exhaust port is controlled by the piston or by poppet valves so that as the piston performs its downstroke the initial flow of exhaust gas is substantially through the first flow path and the subsequent flow of exhaust gas is substantially through the second flow path.

10 Claims, 4 Drawing Sheets

TWO-STROKE OTTO CYCLE ENGINES

The present invention relates to two-stroke Otto cycle engines and is concerned with the exhaust system of such engines.

Two-stroke engines include an inlet port and an exhaust port, both of which may comprise a plurality of spaced openings. Whilst the use of poppet valves is known, at least to control the exhaust port, when used in road vehicles such engines do not normally include poppet valves and the ports are usually provided in the cylinder wall and controlled, that is to say opened and closed, by the piston. The exhaust port opens before the inlet port and closes after it and is thus situated higher up the cylinder wall than the inlet port if the engine is in the usual orientation with the spark plug uppermost.

When the engine is performing its working stroke the exhaust port is opened first and a substantial proportion of the exhaust gas is expelled from the cylinder before the inlet port is opened. As the inlet port opens, the inlet charge, namely fresh air, which may contain fuel, enters the cylinder and displaces and replaces the remaining exhaust gases. The inlet port may communicate directly with an external supply of scavenge air or, in the case of an engine with a carburettor, indirectly via the interior of the crankcase. In the latter case, the cylinder is provided not only with an exhaust port and with an inlet or transfer port which communicates with the interior of the crankcase but also with a further admission port which connects the interior of the crankcase to the carburettor via a one-way valve, such as a Reed valve so that air and fuel are admitted to the interior of the crankcase during the upstroke of the piston but can not leave the crankcase during the downstroke of the piston. During the later portion of each upstroke air is admitted to the crankcase from atmosphere and during the later part of each downstroke air is admitted to the cylinder from the crankcase.

A two-stroke engine naturally emits only small quantities of harmful nitrogen oxides ($N0_x$) but due to increasingly strict pollution and emission control regulations it is increasingly difficult to build a two-stroke engine which emits less than the maximum amount of $N0_x$ permitted by the stricter regulations. Reduction catalysts are known which reduce the $N0_x$ content of exhaust gases, but they are practicable only when the oxygen content of the exhaust gases is low. Unfortunately the oxygen content of the exhaust gases in a two-stroke engine is relatively high for the following reasons:

In order to maximise the efficiency of two-stroke engines it is common to purge residual exhaust gas from the cylinder with the aid of the incoming charge of air and fuel. For this purpose the inlet and exhaust ports are arranged so that there is a period for which they are both uncovered whereby the incoming air and fuel displaces the residual exhaust gas into the exhaust system. However, if this purging is to be efficient it inherently results in a certain proportion of the air and fuel overflowing into the exhaust system, i.e. passing straight through the cylinder without being burnt. The oxygen content of this incoming air represents an additional load on the reduction catalyst and reduces its ability to reduce $N0_x$.

The fuel content of the purge gas which overflows into the exhaust system can be decreased by means of an oxidising catalyst in the exhaust system.

As mentioned above, the ports are generally controlled by the piston but the use of poppet valves whose operation is linked to the crankshaft may be advantageous for certain applications.

It is therefore the object of the present invention to provide a two-stroke engine in which residual exhaust gas may be purged from the cylinder by the incoming charge of air and fuel and whose exhaust system includes reduction and oxidation catalysts but in which the efficiency of the reduction catalyst is not significantly impaired by the presence of oxygen in the exhaust gas.

According to the present invention a two-stroke engine comprising a cylinder accommodating a piston and having an inlet port and an exhaust port, the exhaust port communicating with an exhaust system which includes a reduction catalyst and an oxidation catalyst is characterised in that the exhaust system includes two exhaust flow paths in parallel, the first of which includes a reduction catalyst and the second of which bypasses the reduction catalyst, the downstream ends of the two flow paths being connected together upstream of the oxidation catalyst, and that the exhaust port is so controlled that as the piston performs its downstroke the initial flow of exhaust gas is substantially through the first flow path and the subsequent flow of exhaust gas is at least partly, and preferably substantially, through the second flow path.

Whilst the exhaust port is open for a substantial period of each cycle in a two-stroke engine the present invention is based on the realisation that the majority of the exhaust gas is exhausted in the initial surge as the exhaust port is opened and that this initial surge of exhaust gas contains little or no atmospheric oxygen. This is particularly true when the engine is operating at high loads because the initial surge of exhaust gases is at high pressure. It is also true that the $N0_x$ content of the exhaust gases is highest when the engine is at high loads. Once the inlet port has opened the gases within the cylinder will include a certain proportion of oxygen but the flow of gas through the exhaust port at this stage is under a very much lower pressure.

In the engine of the present invention the exhaust port is so controlled, by the piston or by two or more valves which are opened and closed in synchronism with the engine cycle, that the initial surge of exhaust gas, which contains substantially no oxygen, passes through the reduction catalyst which can then reduce the $N0_x$ in the desired manner but that the subsequent flow of exhaust gas, which contains a proportion of oxygen from the inlet charge, passes through both flow paths. It will be appreciated that the first flow path has a higher flow resistance than the second flow path because it contains the reduction catalyst and thus when both flow paths are open to the interior of the cylinder the exhaust gas flow is predominantly through the second flow path, i.e. through the oxidation catalyst only and not through the reduction catalyst. The reduction catalyst is thus not additionally loaded by atmospheric oxygen and whilst most of the later portion of the gas flow through the exhaust system does not pass through the reduction catalyst only a minor proportion of the total mass of exhaust gas is involved and it is found in practice that a sufficient proportion of the entire volume of exhaust gas is subjected to the reduction catalyst to enable the emitted exhaust gases to meet the desired emission control standard.

The exhaust port may include one or more openings formed in the wall of the cylinder which are controlled by the piston, that is to say are opened and closed by being uncovered and covered, respectively, by the piston. In a first embodiment of this type in accordance with the invention the two flow paths communicate with the interior of the cylinder through one or more respective openings which are spaced apart in the axial direction of the cylinder, the openings of the first flow path being positioned to be uncovered by the piston before the opening(s) of the second flow path. In this embodiment the first flow path is brought into communication with the interior of the cylinder before the second flow path and thus the entire initial flow of exhaust gas flow through the reduction catalyst. Once the opening(s) of the second flow path have been uncovered also the exhaust gas flows substantially only through the second flow path since it will be appreciated that the flow resistance of the second flow path is less than that of the first flow path since it does not include the reduction catalyst.

In a second embodiment of the present invention the upstream ends of the two flow paths are connected together at a point immediately downstream of the exhaust port, the upstream end of the first flow path being positioned closer to the crankcase of the engine than that of the second flow path and subtending an angle of between 30° and 60° to the axis of the cylinder. It will be appreciated that as the edge of the exhaust port remote from the crankcase is the first to be uncovered by the piston the flow of the exhaust gas has not only a radially outward component but also a component towards the crankcase, that is to say a downward component. In this embodiment, the first flow path is positioned to be generally in line with the flow direction of the initial surge of exhaust gas whereby substantially all the initial surge of exhaust gas flows through the first flow path and thus through the reduction catalyst. Once the remainder of the exhaust port has been uncovered by the piston the subsequent flow of exhaust gas, which includes a proportion of oxygen from the inlet port, is substantially through the second flow path since its flow resistance is lower than that of the first flow path. In a preferred arrangement the upstream ends of the first and second flow paths subtend an angle of substantially 45° and 90°, respectively, to the axis of the cylinder.

It is preferred that the exhaust port comprises one or more series of circumferentially spaced openings in the cylinder wall which communicate with a common exhaust manifold with which the first and second flow paths communicate, the second flow path constituting a single pipe and the first flow path constituting a plurality of pipes substantially in alignment with the initial flow of exhaust gas through a respective opening in the cylinder wall.

It is preferred that the piston crown has a chamfered rim or is domed, that is to say that it is convex, since this is found to facilitate the flow of gas into and out of the cylinder and, in the case of the second embodiment, to ease the flow of the initial surge of exhaust gas into the first flow path.

In a third embodiment of the invention the first and second flow paths of the exhaust system again communicate with the interior of the cylinder through separate openings, which openings are controlled by respective valves which are linked to be operated by the crankshaft of the engine such that the first valve opens before the second valve. Thus in this embodiment the different timing of the exhaust gas flows through the first and second paths of the exhaust system is achieved solely by the provision of timed valves which are linked to the crankshaft and thus opened and closed in synchronism with the engine cycle. The timing of the valves and thus the gap between the opening of the first and second valves may be constant or it may be variable, advantageously by means which are known per se, in dependence on the engine operating parameters to match the catalytic action of the exhaust system to the operation of the engine at any particular time. In practice, the first valve will open between 5° and 70° before the second valve. If the relative timing of the two valves is arranged to be varied as the engine load varies, the gap between the opening of the two valves will be towards the upper end of the range at high load and towards the lower end of the range at low load.

Further features and details of the present invention will be apparent from the following description of three specific embodiments which is given by way of example with reference to the accompanying diagrammatic drawings, in which:

FIGS. 1 and 2 are diagrammatic side views of a two-stroke engine in accordance with the invention, FIG. 1 showing the exhaust port only partly open and FIG. 2 showing the exhaust port fully open;

FIGS. 3 and 4 correspond to FIGS. 1 and 2 and show a second embodiment of a two-stroke engine in accordance with the invention;

Figure 1:
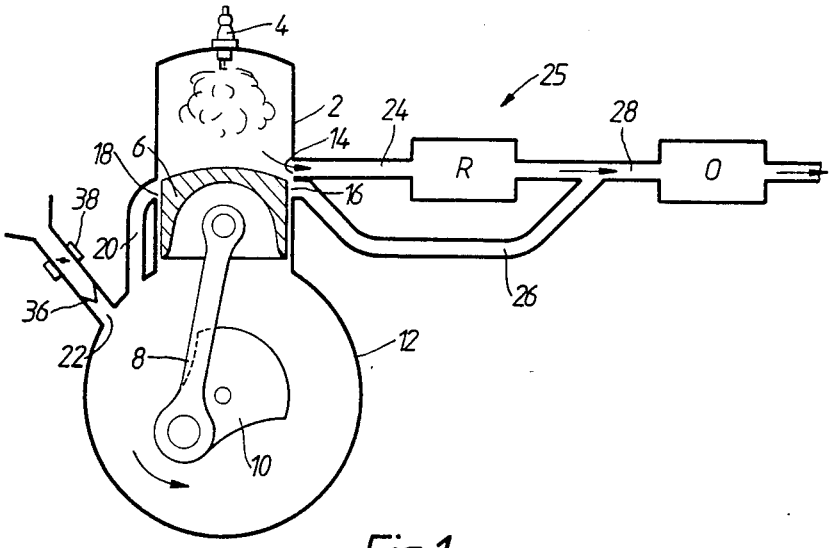
Figure 2:
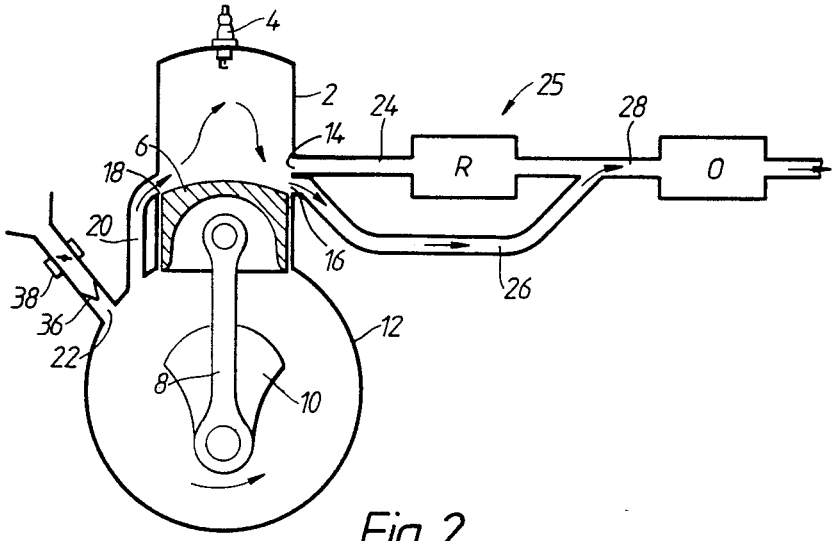

FIGS. 1 and 2 show a crankcase-scavenged two-stroke engine comprising a cylinder 2, through the top of which a spark plug 4 projects and which slidably accommodates the piston 6. The piston 6 is connected by means of a connecting rod 8 to a crankshaft 10 within a crankcase 12. Situated within the side wall is an exhaust port which comprises two peripherally spaced series of openings in the cylinder wall, one series of openings 14 being positioned immediately above the other series 16, as will be described in more detail below. Also positioned in the cylinder wall is the inlet port 18 which comprises a circumferentially spaced series of openings which are positioned slightly below the openings 14. The inlet port 18 communicates with the interior of the crankcase via an inlet line 20. Communicating with the interior of the crankcase are one or more admission ports 22 which communicate with atmosphere via a one-way Reed valve 36 and the engine's carburettor 38.

The exhaust port communicates with an exhaust system 25. Specifically, exhaust openings 14 communicate with a first flow path 24 which includes a reduction catalyst R, typically a porous base of ceramic or metal which is coated with e.g. rhodium, and exhaust openings 16 communicate with a second flow path 26 which bypasses the reduction catalyst. The two flow paths are connected together downstream of the reduction catalyst to form a single exhaust path 28 which includes an oxidation catalyst 0, typically comprising a porous base of ceramic or metal which is coated with e.g. platinum or palladium.

In use, after the spark plug 4 has ignited the fuel/air charge in the cylinder 2 the piston 6 moves downwardly and first uncovers the exhaust openings 14. The high pressure of gas within the cylinder leads to a surge of exhaust gas through the first flow path 24 and thus through the reduction catalyst R. Whilst the piston is moving downwardly it compresses the fuel and air mixture which is present in the crankcase. The piston then uncovers both the exhaust openings 16 and the inlet port 18 and the pressure of the inlet charge in the crankcase 12 results in this flowing rapidly through the transfer passage 20 into the cylinder and thereby displacing the remaining exhaust gases into the exhaust system 25. Due to the fact that the flow resistance of the second flow path 26 is lower than that of the first flow path 24 the majority of the later exhaust gas flow is through the second flow path 26, as illustrated diagrammatically in FIG. 2. During the subsequent upstroke of the piston 6 a fresh charge of air and fuel is drawn into the crankcase 12 through the admission port 22 and the cycle is then repeated.

The engine of FIGS. 3 to 6 (from which the admission port 22 has been omitted for the sake of simplicity) is very similar to that of FIGS. 1 and 2 but instead of the two axially spaced series of exhaust openings there is only a first series of circumferentially spaced exhaust openings 14. The openings 14 communicate with a single exhaust manifold 33 which in turn communicates with the two flow paths. The first flow path 24 constitutes a plurality, in this case three, separate pipes which open through the bottom of the manifold 33 and are positioned circumferentially in positions which correspond to those of the exhaust openings 14. The upstream end of each pipe subtends an angle of about 45° to the cylinder axis. The upstream edge of the opening of each pipe is situated a distance a from the cylinder wall whilst the downstream edge is situated at a distance *b* from the cylinder wall. The dimension *b* is preferably approximately equal to the height of the exhaust openings 14 whilst dimension *a* is preferably in the region of 0 to 0.7*b*. The height of the exhaust openings 14 may be 50% or more of the length of the piston stroke in the case of a high speed engine, e.g. for a racing motorcycle, but may be very much less, e.g. as little as 10% of the piston stroke, in the case of slower running-engines. The three pipes are joined together a short distance downstream of the cylinder 2 and the exhaust pathway then includes a reduction catalyst R and an oxidation catalyst 0. The second flow path 26 communicating with the exhaust manifold 33 is a single pipe which extends perpendicular to the cylinder axis and bypasses the reduction catalyst. The second flow path 26 joins the first flow path 24 at a position between the reduction and oxidation catalysts. In this embodiment, as in the last embodiment, the piston crown is domed, that is to say convex, and this promotes the flow of the initial surge of exhaust gas into the first flow path 24.

In use, when the piston first uncovers the upper edge of the exhaust openings 14 the flow of the initial surge of exhaust gas has not only an outward component but also a downward component and the gas flow is therefore approximately at 45° to the cylinder axis. The jets of gas flowing through the openings 14 flow substantially straight into the first exhaust flow path 24 and thus through the reduction catalyst. As the exhaust openings 14 are opened further the pressure of the exhaust gas drops and its direction becomes more nearly horizontal and the flow then switches progressively to the second flow path 26.

Figure 7:
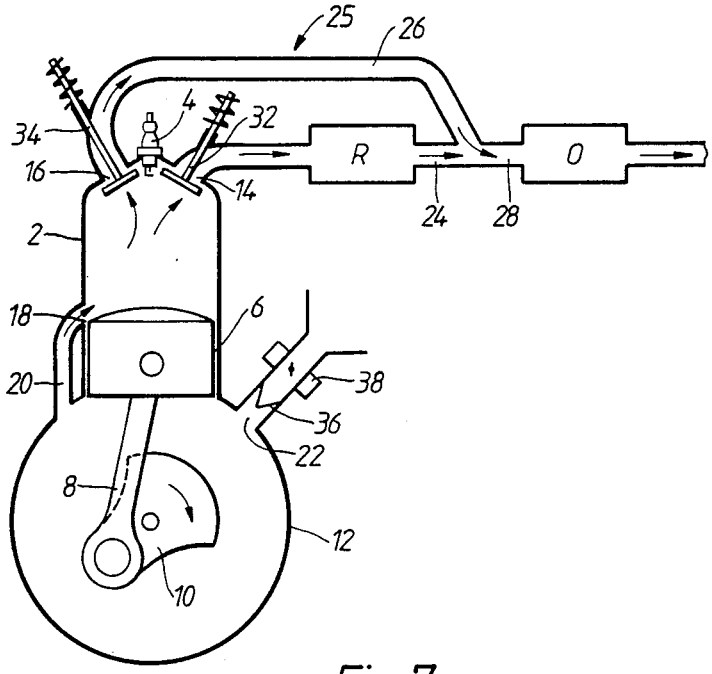
FIG. 7 is a diagrammatic side view of a third embodiment of a two-stroke engine in accordance with the invention.

The engine of FIG. 7 is substantially the same as the engine shown in FIGS. 1 and 2. However, the exhaust port comprises two openings or series of openings 14 and 16 which are positioned at about the same height at the top of the cylinder 2 and which are controlled by respective poppet valves 32 and 34. The poppet valves 32 and 34 are linked to the crankshaft 10 of the engine by any appropriate means, such as a camshaft and push rods of a type well known per se, to be opened and closed as the crankshaft 10 rotates. The connection of the valves 32,34 is such that the first valve 32 opens a short time before the second valve 34.

Figure 3:
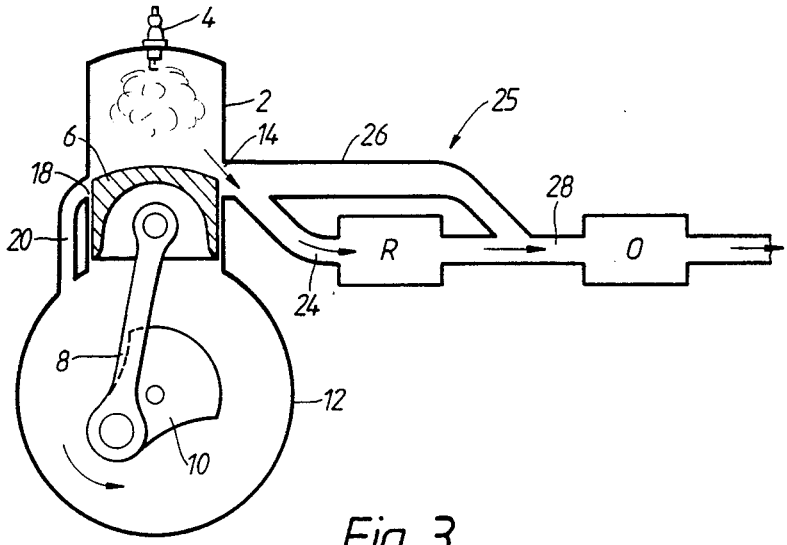
Figure 4:
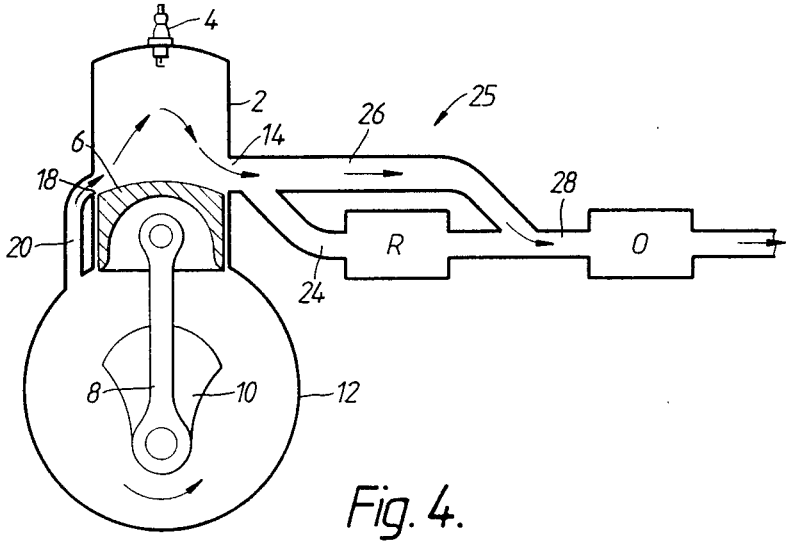
Figure 5:
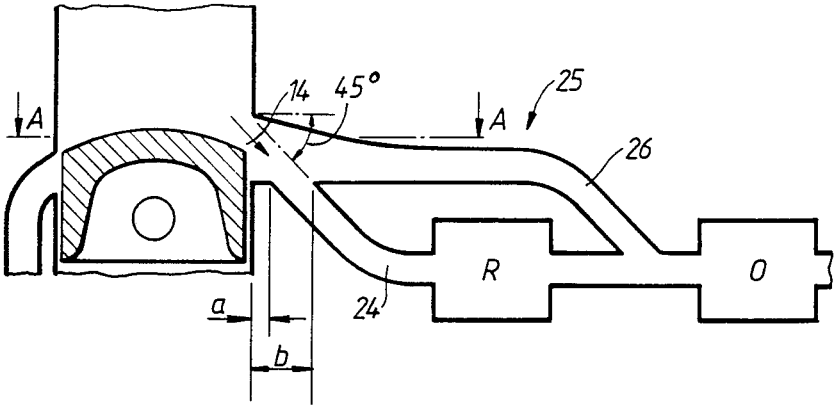
FIG. 5 is a view similar to FIG. 4, but on an enlarged scale with the crankcase, crankshaft and connecting rod omitted.
Figure 6:
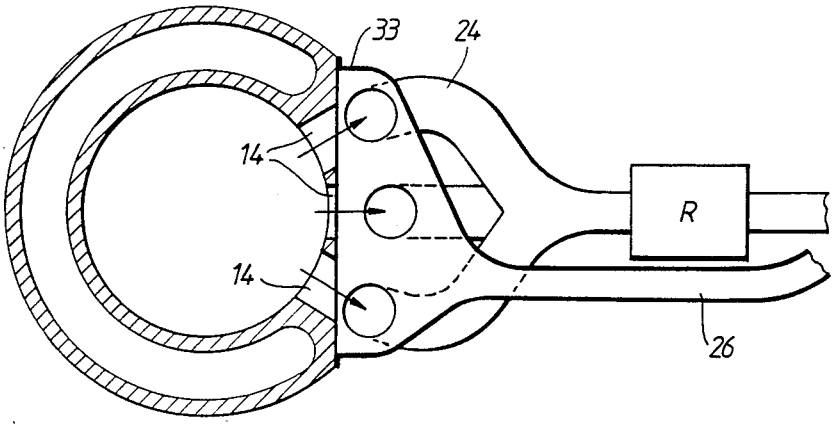
FIG. 6 is a sectional view on the line A—A in FIG. 5.

The operation of this engine will now be described starting from the near bottom dead centre position illustrated in FIG. 3. As the piston moves upwardly the exhaust valves 32 and 34 are initially open and exhaust gases in the cylinder 2 together with a proportion of the inlet charge which has been admitted through the inlet port 18 is displaced into the exhaust system 25. Shortly before the piston passes over and thus closes the inlet port 18 the exhaust valves 32,34 are closed. When the inlet port 18 closes compression begins. Whilst this occurs air is drawn into the crankcase through the carburettor and Reed valve. At or before the top dead centre position of the piston the spark plug 4 is sparked and combustion of the compressed air/fuel mixture in the cylinder results in the piston moving downwardly in its working stroke. As the piston moves downwardly it compresses the inlet charge which has been admitted into the crankcase and a short distance before the inlet port 18 is uncovered the first exhaust valve 32 is opened. This results in a substantial high pressure surge of exhaust gas through the first flow path 24 and this flow is subjected to the reducing action of the reduction catalyst R. As the inlet port 18 is uncovered air in the crankcase is forced through the transfer passage 20 into the cylinder and the second exhaust valve 34 is opened. The inflowing atmospheric air purges substantially all the exhaust gases out of the cylinder and these flow preferentially through the second flow passage 26 since its flow resistance is less than that of the flow passage 24. Whilst a certain proportion of this purged exhaust gas flow will occur through the flow passage 24 and thus through the reduction catalyst the amount involved is very small and thus the reduction catalyst is subjected to only very small amounts of atmospheric oxygen from the inlet charge. When the piston reaches the bottom dead centre position again the above cycle is repeated.

Figure 8:
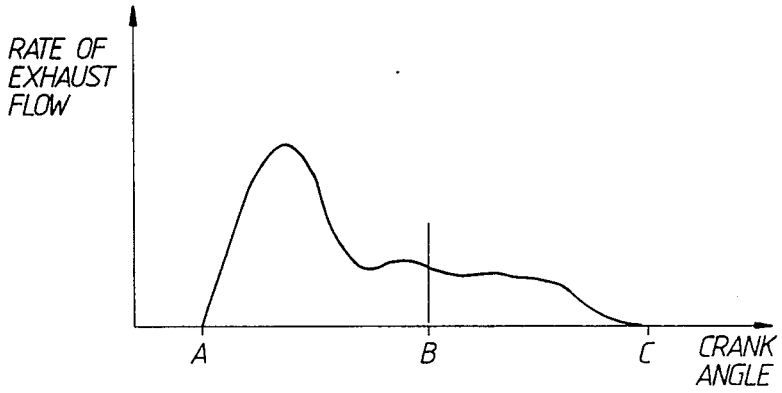
FIG. 8 is a graph showing the rate of exhaust gas flow against the crank angle for an engine in accordance with the invention.

FIG. 8 is a graph which illustrates the rate of exhaust gas flow against crank angle and applies equally to all the embodiments described above. The exhaust ports begin to open at point A and the gas flow rate rises rapidly to a peak value and then begins to fall again as the pressure of the exhaust gas drops. The flow rate has reached a substantially constant value by the time the piston 6 has reached bottom dead centre, which is at point B. The gas flow rate then decreases progressively until it has reached substantially zero at point C at which the exhaust port is closed again. As may be seen from the area under the curve of FIG. 8, the major proportion of the exhaust gas flow is in the initial surge and it is this surge which flows substantially through the reduction catalyst and it is only the latter portion of the exhaust gas flow, that is to say between the points B and C, which contains oxygen and which bypasses the reduction catalyst.

It will be appreciated that an engine in accordance with the present invention need not be of crankcase-scavenged type but that it may also be of the type including a scavenge blower. Whilst the inlet port 18 has been described as being of the type which is covered and uncovered by the piston 6 it may also be of the type which includes a poppet valve and in this event this valve will also be connected to the crankshaft and times to open and close at the appropriate moment.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. A two-stroke engine comprising a cylinder and a piston accommodated in the said cylinder, said cylinder having an inlet port and an exhaust port, said engine further comprising an exhaust system communicating with the said exhaust port and including a first exhaust flow path, a second exhaust flow path in parallel with said first exhaust flow path, a reduction catalyst and an oxidation catalyst, the first exhaust flow path including said reduction catalyst and said second exhaust flow path bypassing said reduction catalyst, said first and second flow paths having respective downstream ends, said downstream ends being connected together upstream of said oxidation catalyst, said exhaust port being so controlled, in operation of said engine, that as said piston performs its downstroke the initial-flow of exhaust gas is substantially through said first flow path and the subsequent flow of exhaust gas is at least partly through said second flow path.

2. An engine as claimed in claim 1 wherein said cylinder has an axis and is defined by a wall and said exhaust port includes one or more openings which are formed in said wall of said cylinder and which are controlled by said piston.

3. An engine as claimed in claim 2 wherein said wall of said cylinder defines first and second sets of openings, each said set comprising at least one opening, said sets of openings being spaced apart in the direction of said axis of said cylinder and said first and second exhaust flow paths communicating with the interior of said cylinder through said first and second sets of openings, respectively, said first set of openings being positioned to be uncovered by said piston before said second set of openings.

4. An engine as claimed in claim 2 wherein said first and second exhaust flow paths have respective upstream ends, said upstream ends being connected together at a point immediately downstream of said exhaust port, said engine further comprising a crankcase, said upstream end of said first exhaust flow path being positioned closer to said crankcase than said upstream end of said second exhaust flow path, said upstream end of said first exhaust flow path subtending an angle of between 30° and 60° to said axis of said cylinder.

5. An engine as claimed in claim 4 wherein said upstream ends of said first and second exhaust flow paths subtend an angle of substantially 45° and 90° , respectively, to said axis of said cylinder.

6. An engine as claimed in claim 4 wherein said exhaust port includes a plurality of circumferentially spaced openings in said wall of said cylinder, said engine further comprising a common exhaust manifold, said common exhaust manifold communicating with said openings and with said first and second exhaust flow paths, said second exhaust flow path constituting a single pipe and said first exhaust flow path constituting a plurality of pipes, said plurality of pipes being substantially in alignment with a respective one of said openings in said wall.

7. An engine as claimed in claim 5 wherein said exhaust port includes a plurality of circumferentially spaced openings in said wall of said cylinder, said engine further comprising a common exhaust manifold, said common exhaust manifold communicating with said openings and with said first and second exhaust flow paths, said second exhaust flow path constituting a single pipe and said first exhaust flow path constituting a plurality of pipes, said plurality of pipes being substantially in alignment with a respective one of said openings in said wall.

8. An engine as claimed in claim 4 wherein said piston has a crown, said crown being convex.

9. An engine as claimed in claim 4 wherein said piston has a crown, said crown having a chamfered rim.

10. An engine as claimed in claim 1 wherein said exhaust port includes a first and a second opening through which said first and second exhaust flow paths respectively communicate with the interior of said cylinder, said engine further comprising first and second valves which control said first and second openings, respectively, and a crankshaft, said first and second valves being linked to be operated by said crankshaft such that said first valve opens before said second valve.

* * * * *